US005101965A

United States Patent [19]

Rutz et al.

[11] Patent Number: 5,101,965

[45] Date of Patent: Apr. 7, 1992

[54] TENTERING CHAIN WITH GUIDE ROLLERS

[75] Inventors: Andreas Rutz, Lindau; Rudolf Langer, Bodolz; Hans-Juergen Maierhofer, Lindau; Adolf Mueller, Weissensberg, all of Fed. Rep. of Germany

[73] Assignee: Lindauer Dornier Gesellschaft mbH, Lindau, Fed. Rep. of Germany

[21] Appl. No.: 616,600

[22] Filed: Nov. 21, 1990

[30] Foreign Application Priority Data

Nov. 25, 1989 [DE] Fed. Rep. of Germany ..... 3939086

[51] Int. Cl.[5] ..... B65G 47/86

[52] U.S. Cl. ..... 198/803.7; 198/803.9; 198/845; 26/91; 26/93; 226/173

[58] Field of Search ..... 198/838, 845, 803.7, 198/803.9; 26/51, 91, 93; 226/173

[56] References Cited

U.S. PATENT DOCUMENTS 3,457,608 7/1969 Gageur ..... 26/91

3,638,289 2/1972 Dornier et al. ..... 26/93

FOREIGN PATENT DOCUMENTS 1925284 11/1970 Fed. Rep. of Germany .

*Primary Examiner*—Joseph E. Valenza

*Attorney, Agent, or Firm*—W. G. Fasse

[57] ABSTRACT

A tentering chain is guided between two guide rails extending in parallel to each other. One guide rail (19*a*) is an outer guide rail with regard to a course followed by the chain, while the other guide rail (19*b*) is an inner guide rail. The chain links are hinged to each other by a journal pin which carries a first guide roller on an inner pin section between chain link plates, and a second guide roller on a cranked outer pin section. Thus, the rotational axes of these two guide rollers extend in parallel to each other and spaced from each other, so that one guide roller can only contact one guide rail, but not the other and vice versa. This feature prevents the reversal of the rotation direction of the guide rollers as they travel along the parallel guide rails.

6 Claims, 2 Drawing Sheets

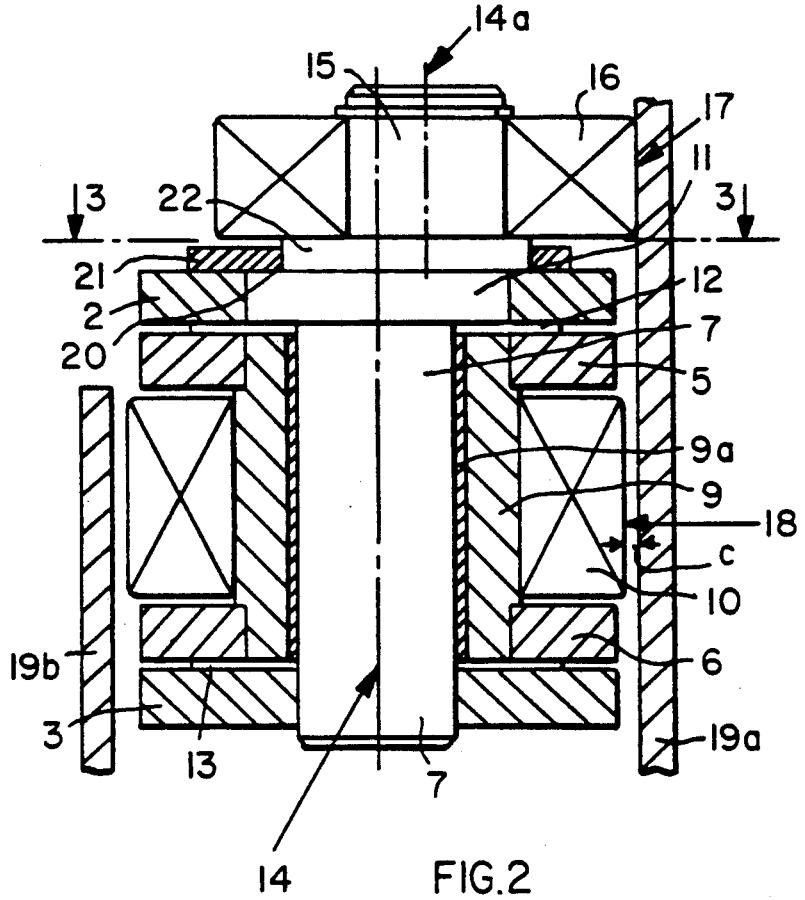
FIG.2
FIG.3
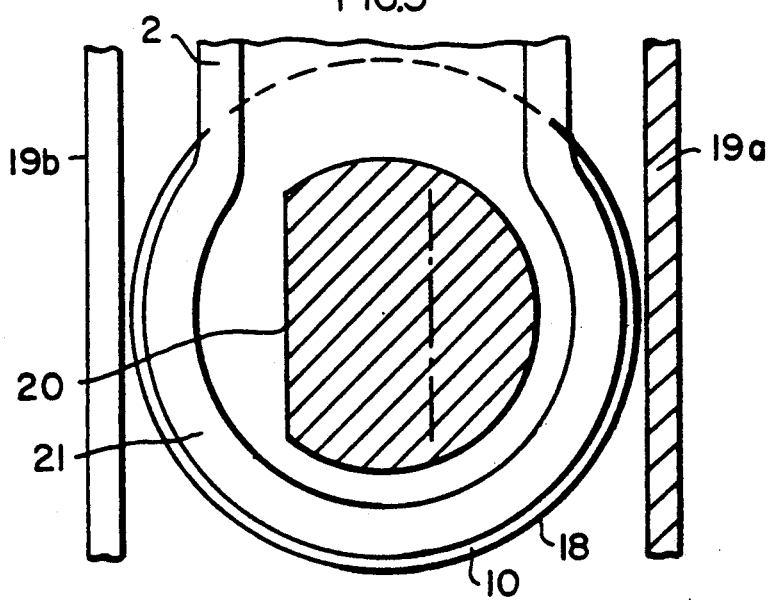

TENTERING CHAIN WITH GUIDE ROLLERS

FIELD OF THE INVENTION

The invention relates to a tentering chain with guide rollers, particularly of the type for stretching synthetic material films.

BACKGROUND INFORMATION

Tentering chains of this type are disclosed in German Patent Publication DE-OS 1,925,284 (Dornier). These tentering chains are conventionally guided between two guide rails which extend in parallel to each other to form a stretching track. Vertical and horizontal forces are taken up by respective guide rollers. The rollers taking up vertical forces function as carrier rollers, while the rollers taking up horizontal forces function primarily as guide rollers. The guide rollers are mounted for rotation on the journal pins which hingedly interconnect two neighboring links of the tentering chain. Thus, the journal pin performs two functions, it mounts the horizontal guide roller and it hinges the chain links to each other.

Tentering chains of this type carry tenter clamps or hooks for holding the fabric or film of synthetic material. It is known in this connection that the tenter clamp body is constructed as part of a chain link. In such structures a horizontal guide roller is mounted for rotation between two neighboring chain links, more specifically, between the connecting plates of two neighboring chain links, whereby the respective guide roller is rotatably supported by the corresponding journal pin that interconnects the two neighboring chain links forming or comprising portions of respective tentering clamps.

It has been found that in these structures the horizontal guide rollers are exposed to high wear and tear during a film stretching operation because, starting at a certain operational speed, the rotational direction of the guide rollers changes due to the fact that the guide rollers either contact one or the other of the two parallel guide rails. Such a directional reversal of the rotation of the guide rollers is undesirable because it contributes substantially to the wear and tear of these rollers. The higher the speed of the tentering chain, and the lower the tension within the chain, the larger is the range within which the tentering clamp can be caused to oscillate back and forth between the two guide rails which also causes wear and tear on the guide surfaces, not only of the guide rollers themselves, but also of the guide rails.

OBJECTS OF THE INVENTION

In view of the above it is the aim of the invention to achieve the following objects singly or in combination:

to assure a defined horizontal guiding of the horizontal guide rollers of a tentering chain so that wear and tear increasing oscillations are prevented;

to arrange horizontal guide rollers in such a manner that the repeated reversal of the rotational direction of the guide rollers is prevented;

to make sure that each horizontal guide roller can engage or contact only its own guide rail and not the opposite guide rail;

to avoid the repeated application of brake forces and acceleration forces to the guide rollers of a tentering chain; and to provide a chain construction capable of substantially higher operational speeds than are possible by conventional tentering chain constructions.

SUMMARY OF THE INVENTION

The above objects have been achieved according to the invention in a tentering chain which is characterized in that a second horizontal guide roller is arranged with its rotational axis eccentrically relative to a rotational axis of a first horizontal guide roller, whereby the spacing between the two rotational axes of the first and second horizontal guide rollers is such and so oriented that one horizontal guide roller can contact only one horizontal guide rail of two such rails while the other horizontal guide roller can contact only the other of said two guide rails which are arranged in parallel to each other alongside a track on which the tentering chain runs. Preferably, one of the two horizontal guide rollers is arranged between the chain link plates of two neighboring chain links and rotatably on a journal pin that interconnects two neighboring chain links, while the other horizontal guide roller is rotatably supported outside the chain link plates on a cranked journal pin section of the journal pin. The rotational axis of the second guide roller is thus located eccentrically to the rotational axis of the first guide roller. Due to this eccentricity the running surface of the second guide roller extends with a spacing in the horizontal direction relative to the running surface of the first guide roller in such a way that this spacing assures the contact of each guide roller only with its respective guide rail. The journal pin or rather the section of the journal pin between the chain link plates and the journal pin section forming the crank, are preferably integral sections of a single piece journal pin.

Further, the eccentricity mentioned above is preferably so directed so that the second guide roller contacts an outer guide rail while the first guide roller contacts an inner guide rail of a pair of guide rails forming part of a track along which the tentering chain runs during a film stretching operation. The terms "outer track" and "inner track" are intended to relate these tracks to the entire tentering frame structure.

All embodiments according to the invention make sure that during the stretching operation, the horizontal guide rollers are not continuously subjected to braking and acceleration forces which heretofore caused the reversal of the rotational direction of the individual guide rollers, thereby exposing these guide rollers to substantial wear and tear. The invention positively avoids such wear and tear, or at least such wear and tear is substantially reduced, not only on the guide rollers, but also on the guide rails. Additionally, the present guide construction permits a substantially higher operational speed for the tentering chains.

BRIEF DESCRIPTION OF THE DRAWINGS

In order that the invention may be clearly understood, it will now be described, by way of example, with reference to the accompanying drawings, wherein:

FIG. 2 is also a vertical section, however, viewed in a different direction as shown by the section line 2—2 in FIG. 1, whereby FIG. 2 further shows two vertically arranged guide rails running in parallel to each other; and FIG. 3 is a sectional view along section line 3—3 in FIG. 2.

Figure 1:
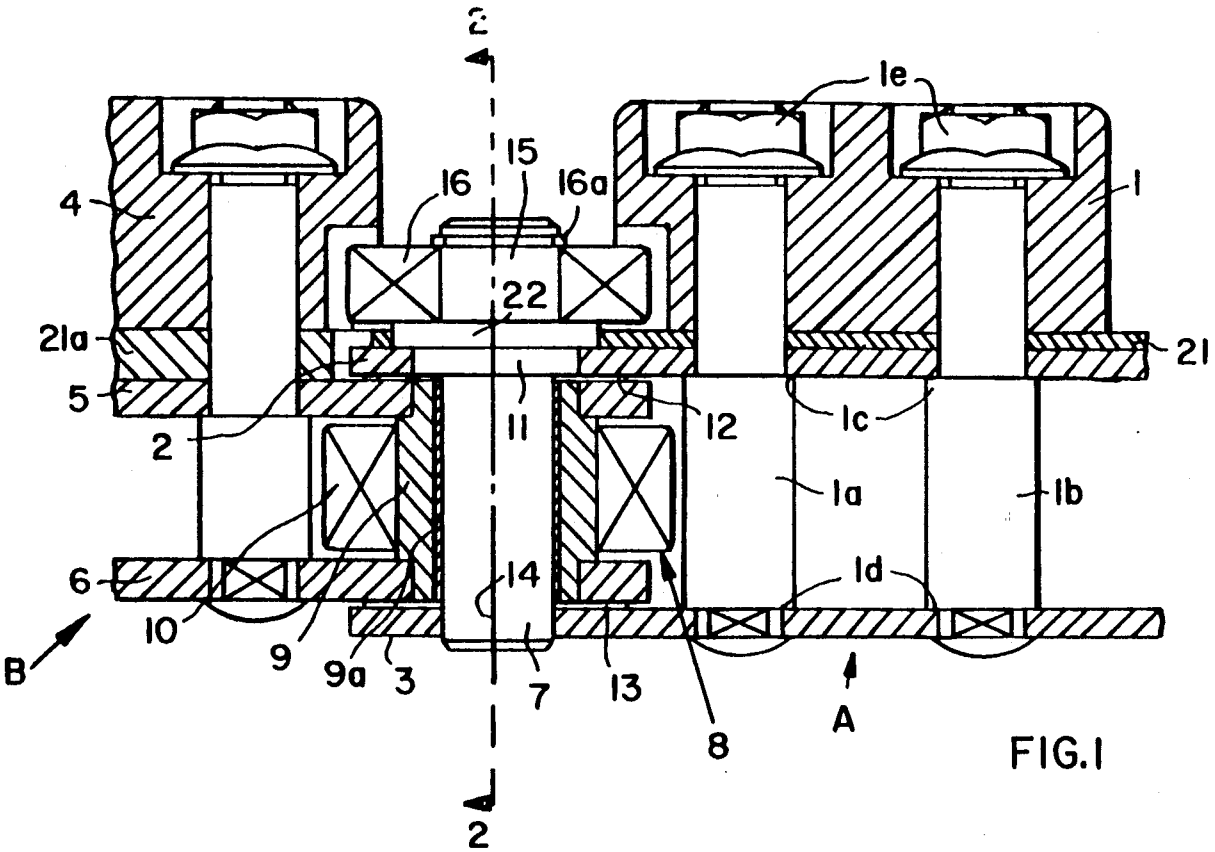
FIG. 1 is a vertical section through two chain links each carrying its own tenter body and interconnected by a journal pin having a vertically extending central axis.

DETAILED DESCRIPTION OF PREFERRED EXAMPLE EMBODIMENTS AND OF THE BEST MODE OF THE INVENTION

Referring first to FIG. 1, a tentering chain comprises a plurality of chain links. Two chain links A and B are shown. All chain links are of the same construction. The chain link A is hingedly connected to chain link B by a journal pin 7. The chain link A comprises two chain link plates 2 and 3 carrying a tenter body 1 for supporting a tenter clamp not shown in detail. The tenter body 1 is secured to its chain link A by two bolts 1*a* and 1*b* having shoulders 1*c* and 1*d* which space the two chain link plates 2 and 3 from each other. Nuts 1*e* hold the tenter body 1 in place. The chain link B is of the same construction. Only one bolt for spacing the chain link plates 5 and 6, and for also mounting a further tenter body 4, is shown. The chain plates 2 and 5 form so-called inner chain plates because they face toward the respective tenter bodies 1 and 4. The chain plates 3 and 6 form so-called outer chain plates, because these plates face outwardly away from the tenter bodies 1 and 4. These tenter chains are endless chains and the tenter bodies 1 and 4 can hinge relative to each other to the same extent the respective chain links A, B can hinge relative to each other as the tentering chain travels along a guide path of which only two horizontal guide rails 19*a* and 19*b* are shown in FIG. 2.

A bearing unit 8 comprising a bearing bushing 9 and a bearing sleeve 9*a* is mounted between the two connecting plates 5 and 6, so that the above mentioned journal pin 7 can extend through the sleeve 9*a* and through openings in the connecting plates 2 and 3 whereby the two chain links A and B are journalled to each other. Thus, a defined journal movement is permitted between the bolt 7 and the bearing bushing 9 and bearing sleeve 9*a*. The sleeve 9*a* reduces friction and is hence made of a material suitable for this purpose. Such materials are well known in the art. An anti-friction washer 12 surrounds the inner journal section of the journal pin 7 so that the anti-friction washer 12 is located between a neck 11 of the journal pin 7, and the axially facing end of the bearing bushing 9. The anti-friction washer 12 is so dimensioned that it is also located between the overlapping portions of the chain link plates 2 and 5. A further anti-friction washer 13 surrounds the lower end of the journal section of the journal pin 7, so that it is located between the axially facing end of the bushing 9 and the chain plate 3. Washer 13 is further so dimensioned that it is also located between the overlapping portions of the chain link plates 3 and 6. The washers 12 and 13 are also made of known anti-friction material.

The inner or lower journal section of the journal pin 7 carries through the bushing 9 and sleeve 9*a* a first guide roller 10 which is rotatable about the central journal pin axis 14. Additionally, the upper or outer end 15 of the journal pin 7 forms a crank section which is seen in better detail in FIG. 2, to be described below. The crank section 15 is integrally connected to the journal pin 7 through a collar or shoulder 22. A second horizontal guide roller 16 is rotatably secured to the crank section 15. The roller 16 is restrained against axial displacement by a spring ring 16*a*. A locking plate 21 has an opening which surrounds the shoulder or collar 22 as will be described in more detail below. The locking plate 21 is rigidly secured to the chain link A by the bolts 1*a*, 1*b* which pass through the locking plate 21 and press the tenter body 1 against the locking plate 21 with the aid of the nuts 1*e*. The second guide roller 16 has a rotational axis 14*a* extending eccentrically relative to said journal pin axis 14 of the first horizontal guide roller 10.

FIG. 2 shows a section along section line 2—2 in FIG. 1 for illustrating the cranked position of the journal pin section 15 relative to the journal pin section 7. The cranked section 15 is referred to as outer section because it is not located between the chain link connecting plates 2, 3, 5, and 6. Rather, crank section 15 is located outside these plates, as best seen in FIG. 2 which also shows the two axes 14 and 14*a*.

According to the invention the diameter dimensions of the first horizontal guide roller 10 and of the second horizontal guide roller 16 and the dimensions of the crank and crank section 15 are so selected that the rolling surface 17 of the second horizontal guide roller 16 projects horizontally outside of the rolling surface 18 of the first horizontal guide roller 10 by a distance C shown in FIG. 2. As a result of this teaching, the first horizontal guide roller 10 cannot contact the surface of the guide rail 19*a*, but only the guide surface of its own guide rail 19*b*. Therefore, direction reversal is prevented because each horizontal guide roller 10, 16 can contact, at all times, only its own guide rail 19*a*, 19*b*. In this connection it is an advantage of the invention that by varying the dimensions of the crank reach, of the crank direction, and of the crank section 15, and by varying the diameters of the rollers 10 and 16, it is possible to vary the above mentioned spacing C which may be referred to as an "overhang" of the upper roller 16 relative to the lower roller 10. Such variation of the overhang C may even be accomplished by rotating the pin 7 slightly so that the direction of the crank is varied. In any event, it is now assured that each guide roller can positively perform its respective horizontal guiding relative to its own guide rail without contacting the other guide rail to thereby greatly diminish or even eliminate the above mentioned wear and tear and to permit higher chain speeds.

FIG. 3 shows a locking mechanism for preventing the axial movement of the journal pin 7 out of the sleeve 9*a* and the bushing 9. For this purpose the above mentioned locking plate 21 is provided. Additionally, the locking plate 21 has a hole with a flattened side wall 20 in which a respectively flattened side wall of the collar 22 is received, whereby rotation of the journal pin 7 relative to the chain link A is prevented. Thus, the locking plate 21 prevents both the axial movement and the rotational movement of the journal pin 7. However, it is also possible to provide a rotational locking by a flattened surface of the neck 11 bearing against a respectively flattened surface of the chain link connecting plate 2. In that case, the locking plate 21 could have a round hole and would serve only as an axial restraint for the pin 7. With plate 21 in place the crank direction cannot be changed any more by simply rotating the journal pin 7 as mentioned above. However, the proper direction of the crank can be adjusted by rotating the pin 7 before the locking plate 21 is in place. At the end of the rotation of pin 7, the latter must be in such a position that the above mentioned flattened surfaces at 20 match with each other for proper mounting of the locking plate 21.

Although the invention has been described with reference to specific example embodiments it will be appreciated that it is intended to cover all modifications and equivalents within the scope of the appended claims.

What we claim is:

1. A tentering chain, comprising a plurality of chain links including chain link plates for carrying tenter clamp bodies, chain link journalling means for hingedly interconnecting two neighboring chain links, said chain link journalling means comprising a fixed journal pin, said tentering chain further comprising first and second guide rollers for each journal pin, said first guide roller being operatively mounted on an inner pin section of said fixed journal pin between said chain link plates, said fixed journal pin including a cranked outer pin section outside said chain link plates, said cranked outer pin section having a central axis extending in parallel to a central journal axis of said journal pin, said second guide roller being operatively mounted on said outer cranked pin section, said first and second guide rollers being arranged for cooperation with guide rails for said tentering chain, whereby said outer cranked pin section makes sure that each of said guide rollers can contact only its respective guide rail to prevent a roller rotation direction reversal of said guide rollers.

2. The tentering chain of claim 1, wherein said cranked outer pin section has a crank dimension, which in combination with diameter dimensions of said first and second guide rollers assure that a guide rail contacting surface of said second guide roller (16) projects laterally toward its respective guide rail (19*a*) sufficiently to prevent said first guide roller (10) from contacting said guide rail (19*a*) of said second guide roller (16) while permitting said first guide roller to contact its own guide rail (19*b*).

3. The tentering chain of claim 1, wherein said cranked outer pin section of said journal pin comprises a cylindrical crank (15) connected to said journal pin, said second guide roller being operatively mounted on said cylindrical crank rigidly against axial displacement, but permitting rotation of said second guide roller around said cylindrical crank.

4. The tentering chain of claim 1, wherein each of said first and second guide rollers is arranged on said journal pin for contacting only its respective guide rail while being prevented from contacting the guide rail of the other guide roller.

5. The tentering chain of claim 4, wherein said guide rails are arranged as an outer guide rail (19*a*) and as an inner guide rail (19*b*) relative to a course followed by said tentering chain, and wherein said second guide roller (16) is arranged on said cranked journal pin section for contacting said outer guide rail (19*a*) while being prevented from contacting said inner guide rail, and wherein said first guide roller (10) is arranged on said inner journal pin section for contacting said inner guide rail (19*b*) while being prevented from contacting said outer guide rail (19*a*).

6. A tentering chain, comprising a plurality of chain links including chain link plates, journal pin means for interconnecting neighboring chain links, a first horizontal guide roller rotatable mounted on said journal pin between said chain link plates, a second horizontal guide roller, and means for mounting said second horizontal guide roller outside said chain link plates in such a position that a rotatational axis of said second guide roller extends in parallel to and with a spacing from a rotational axis of said first horizontal guide roller, said spacing extending in a direction for permitting each guide roller to contact only a respective guide rail while preventing each guide roller from contacting a guide rail of the other guide roller and vice versa, and wherein said mounting means of said second horizontal guide roller comprise a crank forming an integral part of said journal pin means outside said chain link plates.

* * * * *